United States Patent [19]

Hirabayashi et al.

[11] Patent Number: 4,800,686

[45] Date of Patent: Jan. 31, 1989

[54] FABRICATION METHOD FOR CHAMFERED HOLE

[75] Inventors: Toshihiko Hirabayashi, Higashikurume; Keiji Honda, Tokyo, both of Japan

[73] Assignees: Kyokuwei Optical Glass Co., Ltd.; Asahi Diamond Industrial Co., Ltd., both of Tokyo, Japan

[21] Appl. No.: 36,257

[22] Filed: Apr. 9, 1987

[30] Foreign Application Priority Data

Apr. 15, 1986 [JP] Japan ..... 61-86745

[51] Int. Cl.[4] ..... B24B 9/08

[52] U.S. Cl. ..... 51/283 R; 51/206 R; 51/209 R; 408/1 R; 408/27; 407/54

[58] Field of Search ..... 51/204, 206 R, 206 P, 51/209 R, 281 R, 283 R, 283 E, 326, 327, DIG. 6; 408/1 R, 22, 27, 93, 145, 211; 407/54, 119; 125/36; 433/166

[56] References Cited

U.S. PATENT DOCUMENTS

| | | | |
|---|---|---|---|
| 152,442 | 6/1874 | Walters et al. | 51/206 R |
| 2,276,610 | 3/1942 | Clerici | 51/283 R |
| 2,978,846 | 4/1961 | Barron | 51/209 R X |
| 4,483,108 | 11/1984 | Howard | 51/206 R X |
| 4,634,379 | 1/1987 | Nash | 433/166 |

FOREIGN PATENT DOCUMENTS

| | | | |
|---|---|---|---|
| 159308 | 10/1985 | European Pat. Off. | 433/166 |
| 1934915 | 1/1970 | Fed. Rep. of Germany | 51/206 R |

*Primary Examiner*—Robert P. Olszewski

*Attorney, Agent, or Firm*—McAulay, Fields, Fisher, Goldstein & Nissen

[57] ABSTRACT

This invention relates to a method for boring a chamfered hole and a tool for the same hole to effect boring a through hole on a glass plate and to simultaneously effect chamfering on respective aperture on the both sides of the plate, and have the function to enable speedy and accurate boring work without bringing forth defective product with chipping-off, joggles on the glass plate.

3 Claims, 2 Drawing Sheets

PRIOR ART

FABRICATION METHOD FOR CHAMFERED HOLE

BACKGROUND OF THE INVENTION

The present invention relates to a fabrication method and tool for boring a hole in a hard and brittle material, particularly in a glass plate, and chamfering the aperture on the upper-side and both-sides of the plate.

A diamond drill is a tool for boring a hole by removing the workpiece material by grinding with a diamond wheel portion 12 attached to the end of a shank 11 of steel as shown in FIG. 5. In most cases a hollow space 13 penetrating along the center axis of the drill is provided.

In boring a hole in hard and brittle meterials, a diamond drill excells in fabrication efficiencies and fabrication accuracies but have a disadvantage in often chipping-off on the edge of the aperture of a hole it has bored. The chipping-off not only affects the accuracy and appearance but also can lead to a fracture of the glass plate by giving a starting point for a crack.

This chipping-off occurs on the side to which the drill cuts through, and therefore can be prevented by a method where the boring is started on both side of the plate. The boring from the one side stops at the half point of the plate thickness, and the other boring on the other side continues to arrive at the center of the plate thickness for making a through hole.

To make a chamfering, the upper-side and both-sides of the plate is respectively fabricated with a diamond wheel for chamfering after the through hole has been completed. As is shown in the FIG. 6 the chamfering can be made simultaneously with a boring operation with a drill provided with an taperd portion 24 on the upper side of grind wheel portion 22 with a specified diameter.

The above mentioned fabrication from both side of the plate will require two spindles placed opposite each other in alignment in a same axis and the machine used as well as its operation is much complicatd. The alignment between the spindles is not always correct, and therefore such a disadvantage tends to occur as an misalignment between the holes from both side at the point of penetration of the entire hole.

In addition, the apertures on both side of the plate have no chipping off, and however there still remains the risk to make a starting point of a crack in the penetration point within the plate. In order to prevent a method using drills with diameters somewhat different for both side of the plate is used, and however this gives a stepped hole or joggles.

The height H of the portion with a specified diameter in the diamond drill shown in FIG. 6, capable of chamfering is required to be appropriate to the thickness of the glass plate or the workpiece. To control H so as to meet the plate thickness to be fabricated or to compensate H for the wear of the drill tip, a structure is adopted that makes the height H to be adjustable by fitting a diamond wheel body 35 provided with a tapered portion 34 on the drill proper 32. The tip of the tapered portion 34 has a edge of an acute angle, and therefore is fast in its rate of wear, and the rounded tip configuration resulted is copied on the chamfered surface which can not keep uniformity any more. In other words, these chamfering method needs a tool of a complicated structure, and moreover does not give a good finished surface.

OUTLINE OF THE INVENTION

The themes of the present invention is to provide a method and tool to bore a through hole by one operation from the one side of a plate and effect chamfering on both side of the plate with a single diamond drill.

The method of the present invention consists in making a through hole with a larger diameter portion of the drill and, after the completion of the hole, by forcibly contacting the tapered portion of the drill on the edge of the aperture of the hole and by giving such a movement to the relative position between the workpiece and the spindle that makes the forcibly contacted portion to travel the entire circumference of the aperture dege.

Further the tool of the present invention have been provided with tapered portions facing opposite each other, and having angles of the surfaces to be chamfered on the aperture edges on both side of the plate, and further continuing to the diamond wheel portion of a specified diameter.

PREFERRED EMBODIMENT OF THE INVENTION

In connection with the chamfering for a hole after it has been bored through the spindle is fed horizontally while the glass plate is in rotation. The objective of this invention will be achieved also by rotating the spindle while the glass plate remains stationary. The essence consist in the relative motion between the spindle and the workpiece, and the relative motion will only if the motion would make one or more turning on the circumference of the apertures of the hole, while forcibly contacting the tapered portion 4 and 5 respectively on the apertures edges on the upper-side and under-side of the plate.

For example, the glass plate may be fed horizontally while the plate is rotating in alignment with the same axis as the one of the hole, where as the spindle remains stationary. In such a case, the feed mechanism of the spindle becomes a simple construction permitting only a up-and-down movement. Alternatively, a non-rotative circular motion can be adopted in place of the rotation of the glass plate. The non-rotative circular motion can be achieved by X-Y two axis NC control with the glass plate fixed on the X-Y stage and the mechanism for rotation can be dispensed with. According to this method, a plurality of holes to be chamfered can be simultaneously fabricated with a plurality of spindles. All of these processes can be automated by the use of 3-axis control including the up-and-down feeding of spindles.

Figure 1:
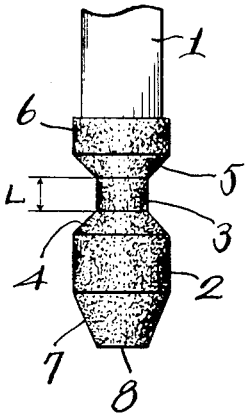
FIG. 1 of the attached drawings is a front elevation of an embodiment of a tool for making a chamfered hole in accordance with the present invention.
Figure 2:
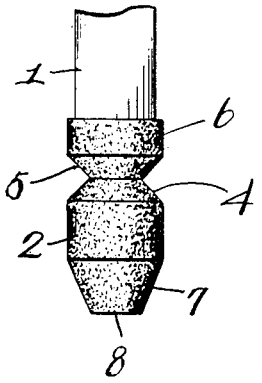
FIG. 2 is a front elevation of another embodiment.

As shown in FIG. 1, the diamond wheel portion at the end of the shank 1 is provided with at the upper part of a cylindrical portion 2, a portion 3 of smaller diameter than the ones of a cylindrical part 2 of a specified diameter and both ends of the portion 3 are made to form tapered surfaces (conical surface) having, for example, a 45° inclination. In addition, the smaller diameter portion 3 is not always necessary, and for a certain thickness of the glass plate, the smaller diameter portion may be dispensed with as shown in FIG. 2, and neighboring tapered surface 4 and 5 may simply face opposite to each other.

The truncated conical portion 7 at the end of the diamond drill in FIG. 1 bores a smaller hole with its tip 8, and then finish the hole to the specified diameter by enlarging the internal surface of the hole. The chipping-off and cracks having occurred at the time of the hole penetration can be removed during the process of the enlarging of hole by grinding and therefore there exist no risk to leave any chipping-off which can not be removed during chamfering.

By the diamond drill shown in FIG. 1, chamfering on both side of the plate as well as the boring of the hole can be performed. That is, all the fabrication required can be performed by one operation on the one side of the workpiece with a single spindle, and accordingly all the disadvantages in the conventional fabrication from both sides of the plate can be all solved and for example, misalignment of the holes due to the misalignment of both spindles, joggles, and crack at the point of the hole penetration, chamfering operation in two times, and resulting complication in tool structures, and non-uniformities at the chamfered surface due to tool wears can be all overcome.

Although in a fabrication apparatus to put the present invention into practice, as mentioned in the embodiment for explanation what is required in addition to the up-and-down feed of the spindle are the function of horizontal feed 42, and function of rotation of workpiece, no technical problem will arise because the examples of such functions exist in many cases in machine tools. Existing mechanism can be also exploited.

Figure 3:
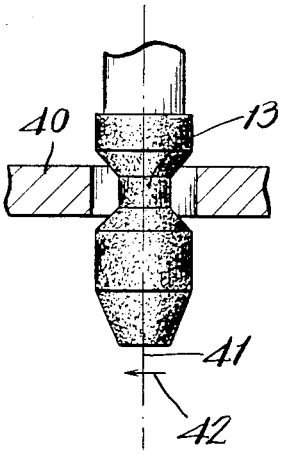
FIG. 3 and FIG. 4 are front elevations for showing a method for boring a chamfered hole by using the tool shown in FIG. 1.
Figure 4:
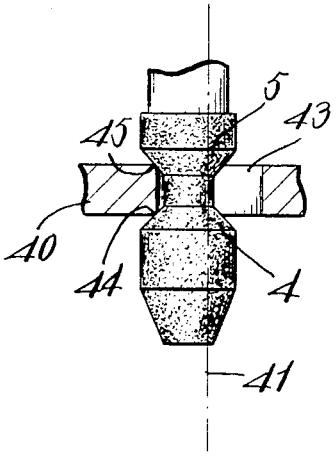

And, after a hole has been bored through with the cylindrical portion 2 of the diamond tool shown FIG. 1 in high-speed rotation, feed the tool further downward to bring the smaller diameter portion 3 to the height of the workpiece or glass plate 40 as shown in FIG. 3, and, while the glass plate is rotated around the center axis 41 of the hole, feed the spindle of the tool in the direction of the arrowmark 42, then, as shown in FIG. 4, the tapered portions 4 and 5 is forcibly contacted on the edge of the upper side and underside aperture of the hole 43 for the chamfering in order to be effected.

FIG. 3 and FIG. 4 show a method to simultaneously effect chamfering both on the upper-side and under-side of the plate. Although this method needs a tool, or diamond drill conforming with the thickness of the workpiece or glass plate, the method is suitable for mass fabrication because of its high efficiency. In this case the length L of the smaller diameter portion 3 is smaller than the thickness of the workpiece. In such a tool, the smaller diameter portion can be omitted, or the configuration may be a V-typed groove formed by the tapered portions 4 and 5 only (refer to FIG. 2).

A tool having the small diameter portion 3 of a longer length L is also useful. The chamfering with such a tool needs operations of two times or for the upper-side and under-side, but this single tool can be used for fabricating plates of various thicknesses. And further the interal surface of a hole can be finished or enlarged by this tool. By the method, a hole of an arbitary diameter larger than the larger diameter portion 2 can be bored as well as subjected to chamfering. Furthermore, by using X-Y two-axis control, a hole of an arbitary shape such as square, hexagonal or other shape (corners should have R larger than the radius of the smaller diameter portion 3) can be bored as well as chamfered.

The essential requirement for the diamond wheel portion of a drill shown in FIG. 1 is the larger diameter portion 2, tapered portions 4 and 5, and, if required, the smaller diameter portion 3. The configuration and dimensions of these portions are defined by the thickness of the workpiece or glass plate and the specification of a hole to be bored. The requirement for the truncated conical portion 7 was mentioned previously. The larger diameter portion 6 in the upper side is not necessarily required by the functions of a drill, but is in general provided for maintaining the geometry of the tapered portion 5.

The above mentioned diamond wheel portion is manufactured as a metal-bond grinding wheel or electrodeposited grinding wheel. Metal-bond wheels feature in long-life, but are expensive in the cost of forming process because of complicated geometries. In electrodeposited wheels, it is easy to manufacture them to a specified configuration with high precision.

Figure 5:
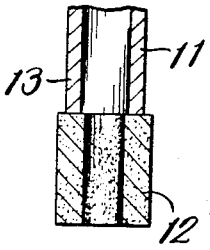
FIG. 5 is a sectional view of a diamond drill conventionally used for making hole and FIG. 6 and FIG. 7 are front elevation of a conventional tool capable of chambering and the one in FIG. 7 is represented by a sectional view.
Figure 6:
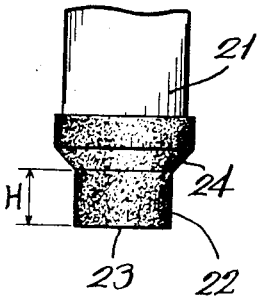
PRIOR ART Fig. 6.
Figure 7:
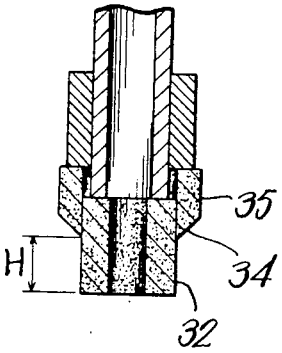
PRIOR ART Fig. 7.

Although not shown in FIG. 1, a hollow space (refer to 13 in FIG. 5) may penetrate the diamond wheel portion from the shank 1 to the tip of the drill to have an opening there and constitute a path for fabricating liquid.

The boring fabrication according to the prevent invention can nullify chipping-offs, cracks, misalignment, stepping or joggles in holes and other disadvantageous occurring in the conventional method, and further is a method from the one side of the workpiece with a single diamond tool, and therefore can effect with a high fabrication efficiency. The method is particularly advantageous to mass fabrication such as boring in automotive window glass and others.

What is claimed is:

1. A method for fabricating a chamfered hole comprising the steps of providing a drill bit with a first tapered portion and an enlarged portion, drilling a hole in a workpiece with said enlarged portion, engaging the edge of the drilled hole with the tapered portion of the drill bit, and effecting relative movement between the drill bit and the workpiece to cause the tapered portion of the drill bit to traverse the circumference of the edge of the hole, said drill bit being provided with a second portion reversely tapered with respect to the first tapered portion, and wherein said method further comprises the step of contacting the upper and lower edges of the hole with the respective first and second tapered portions of the drill bit and effecting relative movement therebetween to cause the tapered portions of the drill bit to traverse the circumferences of the upper and lower edges of the hole.

2. A method as in claim 1, in which a narrow diameter portion of the drill bit connects the first and second tapered portions, said method further comprising engaging the internal surface of the hole with the smaller diameter portion of the drill bit, and effecting relative movement between said drill bit and the workpiece to cause said narrow diameter portion to traverse the inner wall of said hole, and causing at least one of said tapered surfaces to engage and traverse the surface of at least one of the edges of the hole.

3. The method of claim 1, including the further step of axially moving the drill bit relative to the workpiece to align the first and second tapered portions with the plane of the respective upper and lower edges of the workpiece prior to contacting the same.

* * * * *